United States Patent [19]

Hirsch

[11] 4,235,586

[45] Nov. 25, 1980

[54] GAS IGNITION CONTROL

[75] Inventor: James A. Hirsch, Niagara Falls, N.Y.

[73] Assignee: The Carborundum Company, Niagara Falls, N.Y.

[21] Appl. No.: 917,235

[22] Filed: Jun. 20, 1978

[51] Int. Cl.[3] ..... F23N 5/00

[52] U.S. Cl. ..... 431/71

[58] Field of Search ..... 431/2, 6, 46, 67, 69, 431/71, 74, 66

[56] References Cited

U.S. PATENT DOCUMENTS

| | | | |
|---|---|---|---|
| 2,331,712 | 10/1943 | Miller | 431/71 |
| 3,026,937 | 3/1962 | Algino | 431/71 |
| 3,060,997 | 10/1962 | Maney | 431/71 |
| 3,144,898 | 8/1964 | Queever | 431/70 |
| 3,196,923 | 7/1965 | Selinder | 431/71 |
| 4,125,355 | 11/1978 | Rozzi | 431/71 |
| 4,150,938 | 4/1979 | Renshaw et al. | 431/67 |

*Primary Examiner*—Carroll B. Dority, Jr.
*Assistant Examiner*—Lee E. Barrett
*Attorney, Agent, or Firm*—David E. Dougherty; Raymond W. Green; Michael L. Dunn

[57] ABSTRACT

An apparatus for fuel ignition comprising an electrical source for providing electrical current; an electrically operated fuel ignition means; a valve means which allows passage of fuel to the ignition means when the valve means is opened; a first valve control means which will open the valve upon application of an electrical current and a second valve control means which will retain the valve means in an open position but will not initially open the valve upon application of an electrical current; an activating switch electrically connected between the electrical source and the rest of the apparatus so that the apparatus will not operate unless the activating switch is closed; a time delay switch connected between the activating switch and the rest of the apparatus and connected to an ignition sensing switch means so that the time delay switch stops the flow of electrical current to the rest of the apparatus if the ignition sensing switch means does not sense ignition within the time delay; and an ignition sensor for sensing ignition and an ignition sensing switch means responsive thereto. The ignition sensing switch means, when the activating switch is closed, switches electrical current from the first valve control means to the second valve control means after ignition is sensed, shunts out the time delay relay after ignition is sensed and disconnects the ignition means after ignition is sensed. If the ignition sensor ceases to sense that ignition is taking place, the ignition sensing switch again connects the first valve control means, the time delay relay and the ignition means.

7 Claims, 1 Drawing Figure

GAS IGNITION CONTROL

BACKGROUND OF THE INVENTION (A) Field of the Invention

This invention concerns a fuel ignition apparatus which safely controls the passage of fuel to a fuel igniter.

(B) History of the Prior Art

In the prior art, apparatus for safely controlling the flow of fuel to an igniter were known; however, prior art apparatus had serious disadvantages. The first such apparatus were not electrically controlled but were devices subject to mechanical failure. The first such apparatus employing electric igniters were designed to permit the current to stop flowing through the igniter after commencement of combustion of the fuel. In such apparatus, means for stopping flow of current through the electrical igniter was necessary to prevent the igniter from rapidly burning out. In addition, complex systems were required to close the valve through which fuel was supplied in the event that fuel combustion accidentally ceased. Furthermore, such complex valve closing systems were not fail safe since if a critical component of the system became inoperative, a signal would not be supplied to close the fuel valve.

Improved electrical igniters were subsequently developed which permitted continuous flow of current through the igniter during the entire period that fuel flowed from the fuel source. The long life of the improved electrical igniter permitted the continuous operation of the igniter and systems were not used to turn off the igniter after combustion of fuel began due to the complexity of control apparatus and due to the failure of the prior art to provide a fail safe system which would assure that flow of fuel ceased even if a critical component of the system failed.

Examples of prior art patents which disclose igniters which are automatically deactivated after fuel ignition are shown in U.S. Pat. Nos. 1,694,053; 1,708,918; 1,774,137; 2,108,770; and 2,954,080. Each of these patents either discloses a highly complex electrical system which have bulky mechanical support mechanisms, or are not fail safe since the failure of only one particular critical component could permit the continuous flow of fuel without combustion.

For example, U.S. Pat. No. 1,694,053 discloses a complex electrical apparatus which is dependent upon the continued operation of two relays and if either of the relays were to fail in a closed position, fuel could continue to flow without ignition. U.S. Pat. No. 1,774,137 discloses a liquid fuel ignition apparatus which is complex and which is supported by a bulky bucket switch as its fail safe mechanism which would be entirely inoperative if the fuel were a gas. Similarly, U.S. Pat. No. 1,708,918 also depends upon a bulky bucket switch as a fail safe mechanism which would be inoperative if the fuel were a gas. U.S. Pat. No. 2,108,770 discloses a complicated electrical circuit which would permit the continuous flow of fuel without ignition if one set of electrical contacts (41 and 43) were to remain closed. The system is therefore not fail safe since failure of only one component will permit fuel to flow without ignition. U.S. Pat. No. 2,954,080 discloses a fuel ignition apparatus which is not fail safe since if the igniter fails, fuel can continue to flow without ignition and since if a critical relay failed, fuel could continue to flow without ignition.

BRIEF DESCRIPTION OF THE INVENTION

There is therefore provided in accordance with the present invention, a fuel ignition apparatus which is simple in design and is fail safe even if any one of the components in the system were to malfunction. The apparatus for automatic fuel ignition in accordance with the present invention comprises an electrically operated fuel ignition means which reaches a temperature above the ignition temperature of the fuel when a first range of electrical current from an electrical source passes through the ignition means. The apparatus also includes a valve means which allows passage of fuel to the ignition means when the valve means is opened and includes first and second valve control means. The first valve control means will open the valve upon application of a second range of electrical current and the second valve control means will retain the valve means in an open position but will not initially open the valve upon application of the second range of electrical current from the electrical source.

The apparatus further comprises an activating switch electrically connected between the first and second valve control means and the electrical source and between the ignition means and the electrical source so that neither the valve means nor the ignition means will operate unless the activating switch is closed. When the activating switch is closed, it initially connects the first valve control means to the second range of electrical current.

A time delay switch means is also provided which is electrically connected between the electrical source and the first and second valve control means and electrically connected to an ignition sensing switch means. The time delay switch means stops the flow of electrical current to the first and second valve control means after a time delay if the ignition sensing means does not sense that fuel ignition is taking place within the time delay.

An ignition sensor and an ignition sensing switch means responsive to the sensor are also provided. The sensing switch is electrically connected between the first and second valve control means and the electrical source and between the ignition means and the electrical source. The ignition sensing switch means, when the activating switch is closed, switches the electrical source and thus the second range of electrical current from the first valve control means to the second valve control means after the ignition sensor senses that fuel ignition is taking place. The ignition sensing switch means also disconnects the ignition means from the electrical source and the time delay switch means from the electrical source after sensing that fuel ignition is taking place. When the ignition sensor ceases to sense that fuel ignition is taking place, the sensing switch responsive to the sensor reconnects the ignition means to the electrical source, reconnects the time delay switch means to the electrical source and reconnects the first valve control means to the electrical source and the second range of electrical current through the time delay switch means.

If the activating switch fails in a closed position, fuel will flow as long as fuel ignition is sensed but will no longer continue to flow when fuel ignition is not sensed since the time delay switch means will deactivate the fuel valve thus stopping the flow of fuel. If the ignition sensor fails in an open position, ignition will not be sensed and the time delay switch will close the fuel valve. If the ignition sensor fails in a shorted position, combustion will continue until the fuel supply is exhausted or until the activating switch deactivates the second valve control means thus closing the valve. Upon reactivation, the gas valve will not open since the gas valve cannot be activated by the second valve control means to which it is connected due to the shorted position of the ignition sensor.

If the ignition sensing switch means fails in an ignition sensing position, combustion will continue until the fuel is exhausted or the deactivating switch deactivates the fuel valve. The fuel valve cannot then be reactivated since when the ignition sensing switch means fails in the sensing position, the valve means is connected to the second valve control means which cannot open the valve. If the ignition sensing switch means fails in a non-sensing position, the time delay switch means will deactivate the gas valve.

It is therefore clear that any single component within the electrical circuit for operating the valve means, with the single exception of a faulty valve can fail without permitting continuous flow of unignited fuel through the valve. The problem of a faulty valve can be alleviated by using valves in fluid series and valve control means for the valves in electrical series.

DETAILED DESCRIPTION OF THE INVENTION

Figure 1:
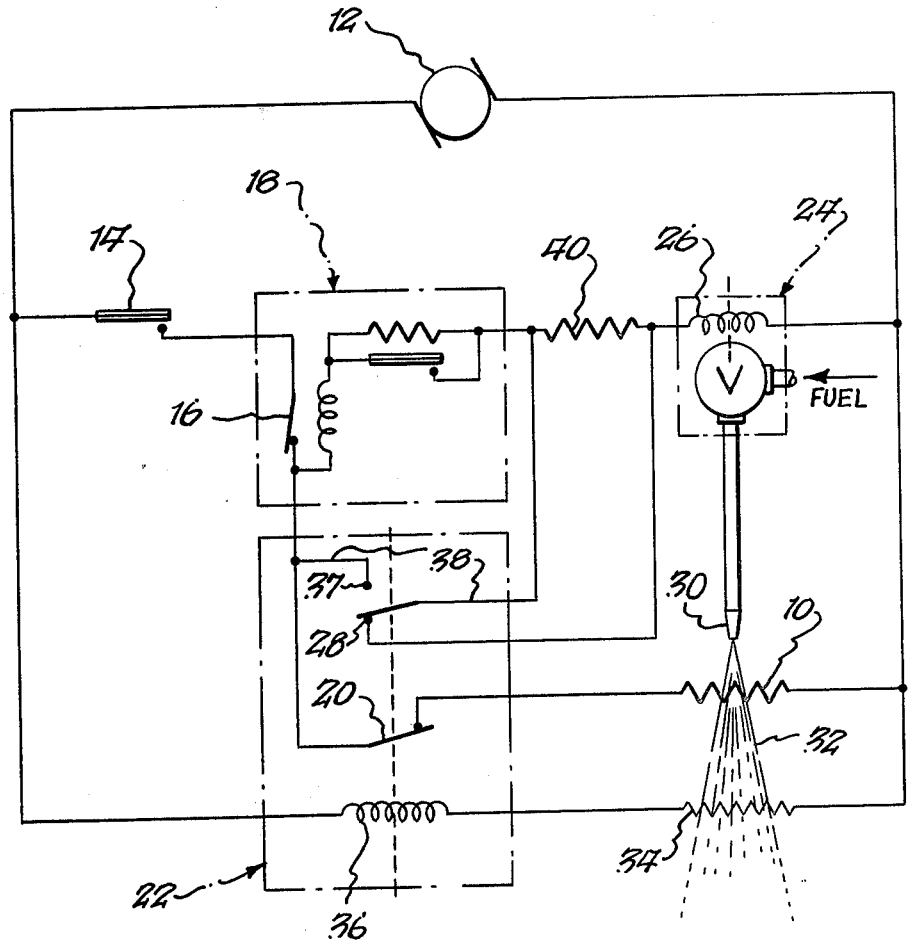
FIG. 1 is an electrical schematic diagram of an apparatus in accordance with the preferred embodiment of the invention.

In accordance with the invention, the automatic fuel ignition apparatus is an apparatus which will function in such a way so that either fuel passing through a fuel valve to the burner is ignited or else the fuel valve is closed to prevent the passage of fuel.

The term "automatic" as used herein means that the apparatus functions to ignite the fuel or close the fuel valve without requiring human action, with the sole exception of an optional human actuated activating switch or override switch.

The fuel, which is ignited by the apparatus in accordance with the invention may be any combustible fuel such as fuel oil, gasoline, kerosene, hydrogen, propane or natural gas. The apparatus in accordance with the invention is particularly suited for the ignition of gaseous fuels such as hydrogen, propane, butane and natural gas.

"Ignition" as used herein means both initial combustion of fuel when fuel begins to flow through a valve means such as a solenoid operated fuel valve and the continued combustion of the fuel as fuel continues to pass through the valve means.

The valve means utilized in the apparatus of the invention may be any suitable remotely controlled means for allowing and stopping the passage of fuel to a fuel burner. The valve means may, for example, be a solenoid operated fuel valve such as a solenoid operated main gas valve or a solenoid operated pilot gas valve. A main gas valve may be used with a pilot valve when it is in fluid series therewith. The remotely actuated valve may be any valve which can be automatically opened and closed such as a solenoid valve or a diaphragm valve which operates on compressed air which is provided when an electrically operated valve in a compressed air line is opened. The valve should, however, be a normally closed valve so that the failure of an operating signal such as compressed air or an electric current would require that the valve remain closed thus preventing the flow of fuel in the event of a failure in the electrical source or intermediate signal such as compressed air.

The ignition means for igniting the fuel comprises any electrical or electronic igniter such as a resistance type or spark type igniter. The ignition means is most desirably a resistance type igniter which reaches a temperature above the ignition temperature of the fuel when sufficient electrical current passes through the igniter. By definition "sufficient electrical current", i.e., first range of electrical current, is that amount of current required to raise the igniter to a temperature above the ignition temperature of the fuel and is dependent upon the particular igniter and fuel selected. The ignition means is most desirably a silicon carbide resistance type igniter.

The electrical source for operating the apparatus in accordance with the invention may be any suitable supply of electrical current such as would be supplied by an electrical generator or by electrical batteries. The electrical source should be able to supply sufficient reliable power at required voltages to operate all of the components of the fuel ignition apparatus. Generally, the voltage requirement is between about 6 and 240 volts and the power requirement is between about 5 and 500 watts.

The first valve control means in accordance with the preferred embodiment is an accompanying electric circuit which permits the application of a first predetermined electrical current which will cause the valve to open. The first electrical current is determined by the valve operator specifications. The second valve control means in accordance with the preferred embodiment in an accompanying electrical circuit which permits the application of a second predetermined electrical current which will permit the valve to remain open but which is insufficient to initially open the valve. For example, a resistance can be provided in series with the coil of a single coil solenoid valve to provide the second valve control means. The resistance would reduce the flow of electrical current to a second predetermined level which would permit the valve to remain open but which would not initially open the valve. When the resistance was removed, as by a shunt, the first valve control means would result which would provide sufficient electrical current to initially open the valve, i.e., a first predetermined electrical current. The first and second control means may alternatively be in the form of a dual electrical winding on a solenoid valve which may be the valve means or may indirectly operate the valve means. One of the windings on the solenoid valve, i.e., the first valve control means, would develop sufficient electromagnetic force to open the valve; whereas, the second coil, i.e., the second valve control means, would not develop sufficient electro-magnetic force to open the valve but would develop sufficient electromagnetic force to retain the valve in the open position.

The time delay switch means may be any time delay switch which can be mechanically or electronically controlled. An example of a desirable time delay switch means is a time delay latching relay which will cut off the flow of electrical current to the valve means thus closing the valve means if ignition is not sensed within the time delay of the relay .

The ignition sensor is any sensor which senses the existence of a flame and may be a photoelectric sensor, a heat actuated relay, e.g., in the form of a bi-metallic strip, or a resistance which has a substantial difference in resistance at cold and hot temperatures. The most desirable sensor in accordance with the present invention is a component which has a substantial difference between its cold and hot temperature resistances.

The ignition sensing switch means is any switch means responsive to a signal from the ignition sensor and is usually a relay which is provided with an actuating electrical current which is controlled either directly or indirectly by the ignition sensor.

The activating switch in accordance with the invention may be a manual or automatic switch and is usually a thermostat.

DESCRIPTION OF THE PREFERRED EMBODIMENTS OF THE INVENTION

Referring now to FIG. 1, the fuel igniter in the form of a silicon carbide high temperature resistance 10 is provided which reaches a temperature above the ignition temperature of the fuel when sufficient electrical current from an electrical source in the form of generator 12 passes through igniter 10. Electrical current from generator 12 reaches igniter 10 when thermostat 14 is closed; contacts 16 of normally closed time delay latching relay 18 are closed; and contacts 20 of relay 22 are closed.

Normally closed solenoid valve 24 is actuated when a first predetermined electrical current from generator 12 passes through solenoid coil 26 of valve 24. The first predetermined electrical current, i.e., sufficient current to open the valve passes through coil 26 when thermostat 14 is closed; contacts 16 of relay 18 are closed and contacts 28 of relay 22 are closed. After solenoid valve 24 is activated, fuel 32 flows through valve 24 through nozzle 30 to igniter 10 where fuel 32 is ignited. Sensor 34 which is an element having substantially lower electrical resistance at elevated temperatures, senses the heat from the combustion of fuel 32 thus lowering its resistance. Sensor 34 is electrically connected in series with coil 36 of relay 22 to generator 12. Lowering of the resistance of sensor 34 permits sufficient current to flow through coil 36 to activate relay 22 thus opening contacts 20 to deactivate igniter 10 and opening contact 28 and closing contact 37 thus placing a shunt 38 about time delay relay 18 and placing a resistance 40 in series with coil 26 of valve 24. The shunt 38 around relay 18 prevents relay 18 from deactivating valve 24 as long as the shunt is in existence. Dropping resistance 40 has a substantially greater resistance than the resistance of relay 18 thus reducing the current flowing through coil 26 of valve 24 to a second predetermined electrical current which is sufficient to hold valve 24 open but would be insufficient to initially open valve 24.

Valve 24 may either be a valve for a pilot or may be a main gas valve. If valve 24 is a valve for a pilot, a main gas valve in fluid series with valve 24, can be operated by means of a system which detects the existence of the pilot flame.

As seen in the FIGURE, the valve will not operate unless thermostat 14 is closed and any single component within the system except a fuel control valve, can fail and unignited fuel will still be prevented from flowing. If the electrical source in the form of generator 12 fails, normally closed valve 24 will not open thus no fuel will flow. If relay 18 fails, in the open position, no current will flow to valve 24 thus no fuel will flow. If relay 18 fails in the closed position, and if all other components are functioning properly, any fuel that flows will be ignited. If relay 22 fails in the position where relay 18 is not shunted, relay 18 will operate to close valve 24. If relay 22 fails in the position where relay 18 is shunted, a position which is not the normal position of relay 22 and which should occur only after ignition, combustion will continue until fuel is exhausted or the current is interrupted either by the thermostat 14 or a limit switch which may be incorporated between the electrical source and the apparatus. Once combustion ceases if relay 22 fails in the shunted position and deactivated igniter position, fuel will not again be permitted to flow until the failure of relay 22 is corrected since dropping resistor 40 will not permit valve 24 to open.

If igniter 10 fails by burning out, time delay relay contacts 16 will close valve 24 since relay 22 will not be activated to shunt time delay relay 18. If igniter 10 fails by shorting, again fuel will not be ignited and the flame will not be sensed by sensor 34 thus relay 22 will not be activated to shunt time delay relay 18 thus valve 24 will be closed.

If sensor 34 fails in an open condition, relay 22 will not be activated thus relay 18 will close valve 24. If sensor 34 fails in a shorted condition, relay 22 will be continuously activated which will prevent valve 24 from opening due to the continuous presence of resistance 40 in series with the coil 26 of valve 24.

Temporary failure of power will cause normally closed valve means 24 to shut off the fuel supply. Temporary failure of fuel supply will cause sensor 34 to cease detecting ignition thus activating relay 22 which activates igniter 10 and time delay relay 18. Time delay relay 18 will shut down the entire system if fuel does not again begin to flow within the time delay .

Time delay relay 18 is a safety device and its failure in a closed position will not affect fuel ignition if all other components are functioning properly. Its failure in an open position will simply shut down the entire apparatus.

What is claimed is:

1. An apparatus for automatic fuel ignition consisting essentially of:

(a) A resistance type electrically operated fuel ignition means which reaches a temperature above the ignition temperature of the fuel when a first range of electrical current from an electrical source passes through the ignition means;

(b) A valve means which allows passage of fuel to the ignition means, when the valve means is opened;

(c) A first valve control means connected to the valve means which will open said valve upon application of a second range of electrical current from said electrical source;

(d) A second valve control means connected to the valve means which will retain said valve in an open position upon the application of said second range of electrical current from said electrical source but will not initially open said valve upon application of said second range of electrical current;

(e) An activating switch electrically connected between said first and second valve control means and said electrical source and between said ignition means and said electrical source so that neither said valve means nor said ignition means will operate unless said activating switch is closed, said activating switch initially connecting said first valve control means to said second range of electrical current;

(f) A time delay switch means electrically connected between said electrical source and said first and second valve control means and electrically connected to an ignition sensing switch means, said time delay switch means stopping the flow of electrical current to said first and second valve control means after a time delay if said ignition sensing switch means does not sense that fuel ignition is taking place within said time delay;

(g) An ignition sensor which senses that fuel ignition is taking place;

(h) Said ignition sensing switch means being responsive to the ignition sensor which ignition sensing switch means is electrically connected between said first and second valve control means and said electrical source and between said ignition means and said electrical source, which ignition sensing switch means, when said activating switch is closed, switches said electrical source from said first valve control means to said second valve control means after the ignition sensor senses that fuel ignition is taking place; which disconnects said ignition means from said electrical source after the ignition sensor senses that fuel ignition is taking place; which disconnects said time delay switch means from said electrical souce after the ignition sensor senses that fuel ignition is taking place; which re-connects said ignition means after the igniter sensor ceases to sense that fuel ignition is taking place; which re-connects said time delay switch means after the ignition sensor ceases to sense that fuel ignition is taking place; and which re-connects said first valve control means to said electrical source and said second range of electrical current through said time delay switch means after the ignition sensor ceases to sense that fuel ignition is taking place.

2. An apparatus for automatic fuel ignition consisting essentially of:

(a) A resistance type fuel igniter which reaches a temperature above the ignition temperature of the fuel when sufficient electrical current from an electrical source passes through the igniter;

(b) A fuel valve which opens upon application of a first predetermined electrical current from said electrical source and which will remain open but will not initially open upon the application of a second predetermined electrical current from said electrical source, said second predetermined electrical current being less than said first predetermined electrical current;

(c) An activating switch electrically connected between said fuel valve and said electrical source and between said igniter and said electrical source so that neither said valve nor said igniter will operate unless said activating switch is closed;

(d) A time delay latching relay having a set of electrical contacts and a first relay coil electrically connected in series between said gas valve and said activating switch, said relay contacts being normally closed to permit current to flow through the apparatus and latching open after said first predetermined current flows through the relay coil for a pre-set time which prevents current from flowing through the apparatus;

(e) A resistance in series with said gas valve, said resistance being large enough to reduce electrical current flowing through the valve, from said first predetermined electrical current which flows through the valve when a low resistance electrical path connects said valve to said electrical source, to said second predetermined electrical current when only said resistance passes electrical current to said valve;

(f) A second set of relay contacts activated by a second relay coil, said contacts being a single pole double throw set of electrical relay contacts, said second contacts normally connecting a low resistance electrical path in the form of a shunt around said resistance, and connecting a shunt around said first relay coil when the second relay coil is activated to complete said shunt around said first relay coil;

(g) A third set of relay contacts also activated by said second relay coil, said third set of relay contacts normally electrically connecting said fuel igniter and said activating switch, said contacts disconnecting said igniter from said activating switch when said second relay coil is activated;

(h) A sensor which is connected in series with said second coil to the electrical source, said sensor normally preventing flow of electrical current through said second relay coil, said sensor being able to detect a flame and upon such detection permitting electrical current to flow through said second relay coil before said trip relay operates to turn off the gas valve, said second relay coil then being activated by said electrical current to activate said second and third set of contacts thus removing the shunt from around the resistance in series with the valve, placing a shunt around the trip relay coil thus deactivating the trip relay and opening the igniter circuit thus deactivating the igniter.

3. The apparatus of claim 2 wherein said fuel valve is a main gas valve.

4. The apparatus of claim 2 wherein said fuel valve is a pilot gas valve.

5. The apparatus of claim 2 wherein said fuel valve is a solenoid valve.

6. The apparatus of claim 2 wherein said resistance type fuel igniter is a silicon carbide resistance igniter.

7. The apparatus of claim 2 wherein said activating switch is a thermostat.

* * * * *